US010676694B2

(12) United States Patent
Saveyn et al.

(10) Patent No.: US 10,676,694 B2
(45) **Date of Patent: *Jun. 9, 2020**

(54) FABRIC SOFTENER COMPOSITION HAVING IMPROVED DETERGENT SCAVENGER COMPATIBILITY

(71) Applicant: The Procter & Gamble Company, Cincinnati, OH (US)

(72) Inventors: Pieter Jan Maria Saveyn, Heusden (BE); Susana Fernandez Prieto, Brussels (BE); Dries Vaes, Houtvenne (BE); Evelyne Johanna Lutgarde Van Hecke, Bachte-Maria-Laarne (BE); Laura Orlandini, Le Mont sur Lausanne (CH); Travis Kyle Hodgdon, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 145 days.

This patent is subject to a terminal disclaimer.

(21) Appl. No.: 15/838,394

(22) Filed: Dec. 12, 2017

(65) Prior Publication Data

US 2018/0179473 A1 Jun. 28, 2018

Related U.S. Application Data

(60) Provisional application No. 62/437,784, filed on Dec. 22, 2016.

(51) Int. Cl.
*C11D 3/00* (2006.01)
*C11D 3/30* (2006.01)
(Continued)

(52) U.S. Cl.
CPC ..... *C11D 3/0015* (2013.01); *C11D 1/62* (2013.01); *C11D 3/222* (2013.01); *C11D 3/30* (2013.01)

(58) Field of Classification Search
CPC ..... C11D 3/0015
See application file for complete search history.

(56) References Cited

U.S. PATENT DOCUMENTS 3,235,596 A * 2/1966 Nordgren ..... C08G 73/0206 106/316
3,397,970 A * 8/1968 Strickland ..... C10L 1/143 44/394

(Continued)

FOREIGN PATENT DOCUMENTS

DE 3588115 T2 2/1997
DE 10203192 A1 8/2003

(Continued)

OTHER PUBLICATIONS

U.S. Appl. No. 15/838,386, filed Dec. 12, 2017, Saveyn, et al.

(Continued)

*Primary Examiner* — Mark Eashoo
*Assistant Examiner* — M. Reza Asdjodi
(74) *Attorney, Agent, or Firm* — Gregory S. Darley-Emerson

(57) ABSTRACT

The present invention relates to fabric softener compositions as well as the methods of making and using same. Such liquid fabric softener compositions comprise a quaternary ammonium ester fabric softening active, cellulose fibers and a hydrotrope. Such fabric softener compositions exhibit improved viscosity stability after addition of a hydrotrope while also delivering the softening benefits that are desired by consumers.

12 Claims, 3 Drawing Sheets

(51) Int. Cl.
*C11D 3/22* (2006.01)
*C11D 1/62* (2006.01)

(56) References Cited

U.S. PATENT DOCUMENTS 3,749,211 A * 7/1973 Cima ..... A45C 5/02 190/109
3,842,976 A * 10/1974 Dea ..... B65D 1/24 206/203
6,022,845 A * 2/2000 Avila-Garcia ..... C11D 1/835 510/101
6,207,601 B1 * 3/2001 Maurer ..... A24D 3/068 131/341
6,410,501 B1 * 6/2002 Jones ..... C11D 1/662 510/515
6,531,438 B1 * 3/2003 Littig ..... C11D 3/0015 510/322
6,790,815 B1 * 9/2004 Bettiol ..... C11D 3/001 510/101
6,875,735 B1 * 4/2005 Frankenbach ..... C11D 1/62 510/522
6,967,027 B1 * 11/2005 Heux ..... C08J 3/03 424/484
2001/0021692 A1 * 9/2001 Mohammadi ..... C11D 1/835 510/515
2002/0193274 A1 12/2002 Skold et al.
2003/0224965 A1 * 12/2003 Conley ..... D06F 58/203 512/1
2005/0202990 A1 * 9/2005 Caswell ..... A47F 1/08 510/295
2005/0256020 A1 * 11/2005 Gardner ..... B82Y 30/00 510/392
2008/0207481 A1 * 8/2008 Meine ..... C11D 3/50 512/4
2010/0292474 A1 * 11/2010 Demeyere ..... C07D 233/22 544/335
2011/0237490 A1 9/2011 King
2011/0245138 A1 * 10/2011 Kohle ..... C07C 213/06 510/515
2011/0275553 A1 * 11/2011 Leopold ..... C11D 1/62 510/516
2012/0142579 A1 * 6/2012 Panandiker ..... C11D 1/62 510/516
2013/0298948 A1 11/2013 Company et al.
2015/0159119 A1 * 6/2015 Fernandez-Prieto .... C11D 1/62 510/527
2016/0281034 A1 * 9/2016 Panandiker ..... C11D 3/3742
2018/0179470 A1 * 6/2018 Saveyn ..... C11D 3/0015
2018/0179471 A1 6/2018 Saveyn
2018/0179472 A1 6/2018 Saveyn
2018/0179473 A1 * 6/2018 Saveyn ..... C11D 1/62

FOREIGN PATENT DOCUMENTS

DE 102007021792 A1 11/2008
EP 0918086 A1 5/1999
EP 2196527 A1 6/2010
EP 2824169 A1 1/2015
WO 9927050 A1 6/1999
WO WO-9927050 A1 * 6/1999 ..... C11D 1/62
WO WO02092742 A1 11/2002
WO 2003062361 A1 7/2003
WO 2003085074 A1 10/2003
WO WO2006124338 A1 11/2006
WO WO2008057985 A1 5/2008
WO WO2008076753 A1 6/2008
WO WO2008079693 A1 7/2008
WO WO2008135333 A1 11/2008
WO 2010003860 A2 1/2010
WO WO2011056956 A1 5/2011
WO WO-2011123606 A1 * 10/2011 ..... C11D 1/62
WO WO2011139578 A1 11/2011
WO WO2012052349 A1 4/2012
WO WO2013063171 A1 5/2013
WO 2013174603 A1 11/2013
WO WO2015006635 A1 1/2015
WO WO2016014733 A1 1/2016

OTHER PUBLICATIONS

U.S. Appl. No. 15/838,390, filed Dec. 12, 2017, Saveyn, et al.
U.S. Appl. No. 15/838,392, filed Dec. 12, 2017, Saveyn, et al.
Cocquyt, Jan, et al.; Interaction kinetics of anionic surfactants with cationic vesicles; Colloids and Surfaces A: Physicochem. Eng. Aspects; 298(2007); pp. 22-26.
Extended European Search Report; Application No. 16206277.2-1375; dated Jun. 30, 2017; 6 pages.
Extended European Search Report; Application No. 16206285.5-1375; dated Jun. 30, 2017; 6 pages.
Extended European Search Report; Application No. 16206289.7-1375; dated Jun. 30, 2017; 6 pages.
International Search Report; International Application No. PCT/US2017/066942; dated Jun. 20, 2018; 13 pages.
Product Safety Assessment; TERGITOL 15-S Surfactants; Ethoxylated Nonionic Surfactants Info.; The Dow Chemical Company; Created: Apr. 5, 2011; 6 pages.

* cited by examiner

Figure 3: Apparatus B
Figure 3 Apparatus B Example
Circulation Loop System
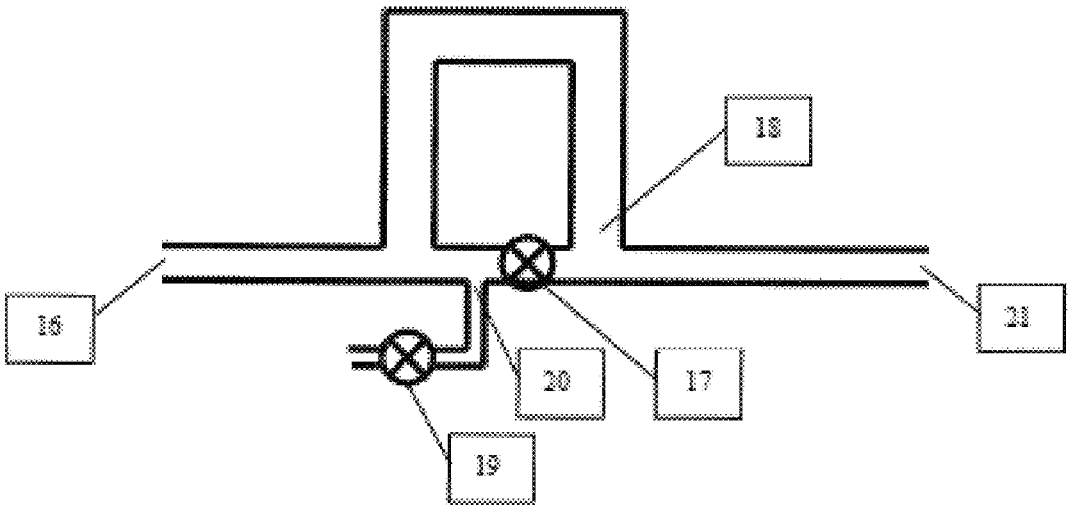

FABRIC SOFTENER COMPOSITION HAVING IMPROVED DETERGENT SCAVENGER COMPATIBILITY

FIELD OF THE INVENTION

The invention is directed to fabric softener compositions.

BACKGROUND OF THE INVENTION

Fabric softener compositions provide benefits to treated fabrics, particularly in the last rinse phase of the laundry process, after the addition of the detergent composition in the wash phase. Such benefits include fabric softening, provided by the incorporation of fabric softener actives. However, there is increasing interest to reduce water and energy usage during the laundry process which can be achieved by lowering the number of rinse cycles. However, with a low number of rinse cycles, the deposition of fabric softener actives is reduced and hence the softening of the fabrics is less. Without wishing to be bound by theory, it is believed that this is due to the residual anionic detergent which remains in the last rinse. Cocquyt et al. (Colloids and Surfaces A: Physicochem. Eng. Aspects 298 (2007) 22-26) showed that anionic detergent can interact with the cationic fabric softener actives to form an insoluble complex. To prevent formation of such insoluble complex, hydrotropes can be added to the fabric softener composition to form a preferred complex between the anionic detergent and the hydrotrope. It is believed that such a preferred complex is formed when a hydrotrope is hydrophilic enough to not associate with the softener active vesicles but still hydrophobic enough to preferentially complex with the anionic detergent. Thus, the anionic detergent cannot interfere with the deposition of the softener active. However, it has been found that the addition of such detergent scavenging hydrotropes causes a drop in the viscosity of fabric softener compositions. Such a drop in viscosity can lead to consumer dissatisfaction as it can give the impression of a lack of "richness" of the formula. The drop in viscosity is particularly noticeable for fabric softener compositions comprising rheology modifiers such as cationic polymeric rheology modifiers. Such rheology modifiers are typically used to ensure phase stability, optimize the viscosity to connote richness of the formulation, and improve the pouring experience. The viscosity drop results in the need for an additional process step, whereby additional rheology modifier is post-added to restore the viscosity to the initial level. However, such a solution has several disadvantages related to increased manufacturing complexity. It requires an extra manufacturing step to add the additional rheology modifier. Furthermore, when other ingredients of the fabric softener composition are changed or different levels of hydrotrope are added, the viscosity drop will vary. As a consequence, several iterations may be required to determine the level of additional rheology modifier needed to restore the viscosity to the target level.

Hence, there is still a need for a fabric softener composition with a rich appearance comprising a fabric softening active which exhibits improved viscosity stability upon the addition of detergent scavenging hydrotrope without increasing manufacturing complexity.

WO2008/076753 (A1) relates to surfactant systems comprising microfibrous cellulose to suspend particulates. WO2008/079693 (A1) relates to a cationic surfactant composition comprising microfibrous cellulose to suspend particulates. WO2015/006635 relates to structured fabric care compositions comprising a fabric softener active and microfibrillated cellulose. WO03/062361 (A1) discloses liquid fabric conditioners comprising cellulose fibers and esterquats. WO2010003860 relates to liquid cleansing compositions comprising microfibrous cellulose suspending polymers. WO02092742 (A1) relates to fabric softening compositions, preferably translucent, clear or transparent conditioners, which in addition to a cationic fabric softener comprise a fabric co-softener, and a hydrotope. WO2016/014733 (A1) relates to treatment compositions comprising a polymer system and a cationic hydrotrope.

SUMMARY OF THE INVENTION

The present invention relates to liquid fabric softener compositions comprising a quaternary ammonium ester fabric softening active, cellulose fibers, and a cationic hydrotrope. The present invention further relates to the use of cellulose fibers in liquid fabric compositions.

The compositions of the present invention provide improved viscosity stability and pouring experience, while avoiding the need to post-add additional rheology modifier in order to arrive at the target viscosity.

BRIEF DESCRIPTION OF THE DRAWINGS

While the specification concludes with claims particularly pointing out and distinctly claiming the invention, it is believed that the invention will be better understood from the following description of the accompanying figures in which like reference numerals identify like elements, and wherein:

FIG. 3 details the Apparatus B (see Methods).

DETAILED DESCRIPTION OF THE INVENTION

Definitions

Figure 1:
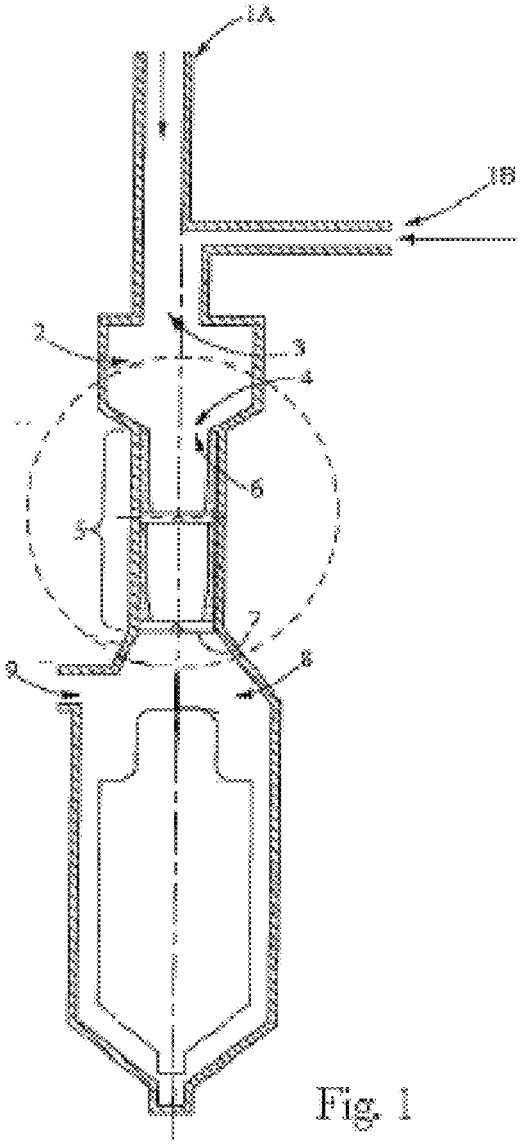
FIG. 1 details the apparatus A (see Methods).

As used herein, the articles including "a" and "an" when used in a claim, are understood to mean one or more of what is claimed or described.

As used herein, the terms "include", "includes" and "including" are meant to be non-limiting.

Unless otherwise noted, all component or composition levels are in reference to the active portion of that component or composition, and are exclusive of impurities, for example, residual solvents or by-products, which may be present in commercially available sources of such components or compositions. For example, it is known that quaternary ammonium esters typically contain the following impurities: the monoester form of the quaternary ammonium ester, residual non-reacted fatty acid, and non-quaternized esteramines.

All percentages and ratios are calculated by weight unless otherwise indicated. All percentages and ratios are calculated based on the total composition unless otherwise indicated.

All ratios are calculated as a weight/weight level of the active material, unless otherwise specified.

All measurements are performed at 25° C. unless otherwise specified.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The Liquid Fabric Softener Composition

As used herein, "liquid fabric softener composition" refers to any treatment composition comprising a liquid capable of softening fabrics e.g., clothing in a domestic washing machine. The composition can include solids or gases in suitably subdivided form, but the overall composition excludes product forms which are non-liquid overall, such as tablets or granules. The liquid fabric softener composition preferably has a density in the range from 0.9 to 1.3 $g \cdot cm^{-3}$, excluding any solid additives but including any bubbles, if present.

Aqueous liquid fabric softening compositions are preferred. For such aqueous liquid fabric softener compositions, the water content can be present at a level of from 5% to 97%, preferably from 50% to 96%, more preferably from 70% to 95% by weight of the liquid fabric softener composition.

The Ph (see Methods) of the neat fabric softener composition is typically acidic to improve the hydrolytic stability of the quaternary ammonium ester softening active and may be from pH 2.0 to 6.0, preferably from pH 2.0 to 4.5, more preferably from 2.0 to 3.5.

To provide a rich appearance while maintaining pourability of the fabrics softener composition, the viscosity of the fabric softener composition may be from 50 mPa·s to 800 mPa·s, preferably from 100 mPa·s to 600 mPa·s, more preferably from 150 mPa·s to 500 mPa·s as measured with a Brookfield® DV-E rotational viscometer (see Methods).

To maintain phase stability of the fabric softener composition, the dynamic yield stress (see Methods) at 20° C. of the fabric softener composition may be between 0.001 Pa and 1.0 Pa, preferably between 0.005 Pa and 0.8 Pa, more preferably between 0.01 Pa and 0.5 Pa. The absence of a dynamic yield stress may lead to phase instabilities such as particle creaming or settling in case the fabric softener composition comprises suspended particles. Higher dynamic yield stresses may lead to undesired air entrapment during filling of a bottle with the fabric softener composition.

The Quaternary Ammonium Ester Softening Active

The liquid fabric softener composition of the present invention comprises from 3.0% to 25.0% of a quaternary ammonium ester softening active (Fabric Softening Active, "FSA"). In preferred liquid fabric softener compositions, the quaternary ammonium ester softening active is present at a level of from 4.0% to 20%, more preferably from 5.0% to 15%, even more preferably from 7.0% to 12% by weight of the composition. The level of quaternary ammonium ester softening active may depend of the desired concentration of total softening active in the composition (diluted or concentrated composition) and of the presence or not of other softening active.

Preferably the iodine value (see Methods) of the parent fatty acid from which the quaternary ammonium fabric softening active is formed is from 0 to 100, preferably from 10 to 60, more preferably 15 to 45.

Suitable quaternary ammonium ester softening actives include but are not limited to, materials selected from the group consisting of monoester quats, diester quats, triester quats and mixtures thereof. Preferably, the level of monoester quat is from 2.0% to 40.0%, the level of diester quat is from 40.0% to 98.0%, the level of triester quat is from 0.0% to 25.0% by weight of total quaternary ammonium ester softening active.

Said quaternary ammonium ester softening active may comprise compounds of the following formula:

$$\{R^2_{(4-m)}—N+-[X—Y—R^1]_m\}A-$$

wherein:

m is 1, 2 or 3 with proviso that the value of each m is identical;

each $R^1$ is independently hydrocarbyl, or branched hydrocarbyl group, preferably $R^1$ is linear, more preferably $R^1$ is partially unsaturated linear alkyl chain;

each $R^2$ is independently a $C_1$-$C_3$ alkyl or hydroxyalkyl group, preferably $R^2$ is selected from methyl, ethyl, propyl, hydroxyethyl, 2-hydroxypropyl, 1-methyl-2-hydroxyethyl, poly($C_{2-3}$ alkoxy), polyethoxy, benzyl;

each X is independently $(CH_2)n$, $CH_2$—$CH(CH_3)$— or CH—$(CH_3)$—$CH_2$— and each n is independently 1, 2, 3 or 4, preferably each n is 2;

each Y is independently —O—(O)C— or —C(O)—O—;

A- is independently selected from the group consisting of chloride, methylsulfate, and ethylsulfate, preferably A- is selected from the group consisting of chloride and methylsulfate;

with the proviso that when Y is —O—(O)C—, the sum of carbons in each $R^1$ is from 13 to 21, preferably from 13 to 19.

Examples of suitable quaternary ammonium ester softening actives are commercially available from KAO Chemicals under the trade name Tetranyl AT-1 and Tetranyl AT-7590, from Evonik under the tradename Rewoquat WE16 DPG, Rewoquat WE18, Rewoquat WE20, Rewoquat WE28, and Rewoquat 38 DPG, from Stepan under the tradename Stepantex GA90, Stepantex VR90, Stepantex VK90, Stepantex VA90, Stepantex DC90, Stepantex VL90A.

These types of agents and general methods of making them are disclosed in U.S. Pat. No. 4,137,180.

Cellulose Fibers:

The liquid fabric softener composition of the present invention comprises cellulose fibers. Cellulose fibers thicken, and improve the phase stability of the fabric softener composition, but also surprisingly provide improved viscosity stability of liquid fabric softener compositions in the presence of a cationic hydrotrope.

The composition of the present invention comprises cellulose fibers, preferably from 0.01% to 5.0%, preferably 0.05% to 1.0%, more preferably from 0.1% to 0.75% of cellulose fibers by total weight of the fabric softener composition.

Suitable cellulose fibers include microfibrous cellulose or cellulose nano fibrils. The cellulose fibers can be of bacterial or botanical origin, i.e. produced by fermentation or extracted from vegetables, plants, fruits or wood. Cellulose fiber sources may be selected from the group consisting of citrus peels, such as lemons, oranges and/or grapefruit; fruits, such as apples, bananas and/or pear; vegetables such as carrots, peas, potatoes and/or chicory; plants such as bamboo, jute, abaca, flax, cotton and/or sisal, cereals, and different wood sources such as spruces, *eucalyptus* and/or oak. Preferably, the cellulose fiber source is selected from the group consisting of wood or plants, in particular, spruce, *eucalyptus*, jute and sisal.

The content of cellulose in the cellulose fibers will vary depending on the source and treatment applied for the extraction of the fibers, and will typically range from 15 to 100%, preferably above 30%, more preferably above 50%, and even more preferably above 80% of cellulose by weight of the cellulose fibers.

Such cellulose fibers may comprise pectin, hemicellulose, proteins, lignin and other impurities inherent to the cellulose based material source such as ash, metals, salts and combinations thereof. The cellulose fibers are preferably non-ionic. Such fibers are commercially available, for instance Citri-Fi 100FG from Fiberstar, Herbacel® Classic from Herbafood, and Exilva® from Borregaard.

The cellulose fibers may have an average diameter from 10 nm to 350 nm, preferably from 30 nm to 250 nm, more preferably from 50 nm to 200 nm.

Hydrotrope

Hydrotropes are compounds that have a hydrophilic and hydrophobic part wherein the hydrophobic part is too small to cause spontaneous self-aggregation. The liquid fabric softener composition of the present invention comprises 0.005% to 1.0% by weight of the composition of a cationic hydrotrope. Unlike alkaline earth metal salts or earth alkali metals, cationic hydrotropes are believed to form a complex with the residual anionic detergent in the rinse water. Suitable cationic hydrotropes may have the general structure:

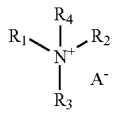

wherein:

each $R_1$, $R_2$, $R_3$, $R_4$ is independently selected from C1 to C4 alkyl, C1 to C4 hydroxyalkyl, or C2-C4 alkoxy alcohol, preferably $R_1$ is methyl, more preferably $R_1$, $R_2$, $R_3$, $R_4$ is independently selected from methyl, ethyl, propyl, hydroxyethyl, 2-hydroxypropyl, 1-methyl-2-hydroxyethyl;

$A^-$ is independently selected from the group consisting of chloride, methyl sulfate, and ethyl sulfate, preferably A- is selected from the group consisting of chloride and methyl sulfate.

With the proviso that the hydrotrope comprises at least 5 carbon atoms, preferably 6 to 8 carbon atoms in total. Preferred levels of such hydrotropes is 0.005% to 1.0% by weight of the composition.

Preferred hydrotropes are selected from the group consisting of bis (2-hydroxyethyl) dimethylammonium chloride, bis (2-hydroxyethyl) dimethylammonium methylsulfate, tris(2-hydroxyethyl) methylammonium chloride, tris(2-hydroxyethyl) methylammonium methylsulfate, bis (2-hydroxypropyl) dimethylammonium chloride, bis (2-hydroxypropyl) dimethylammonium methylsulfate, bis (1-methyl-2-hydroxyethyl) dimethylammonium chloride, bis (1-methyl-2-hydroxyethyl) dimethylammonium methylsulfate and mixtures thereof.

Dispersed Perfume

The liquid fabric softener composition of the present invention may comprise a dispersed perfume composition. By dispersed perfume we herein mean a perfume composition that is freely dispersed in the fabric softener composition and is not encapsulated. A perfume composition comprises one or more perfume raw materials. Perfume raw materials are the individual chemical compounds that are used to make a perfume composition. The choice of type and number of perfume raw materials is dependent upon the final desired scent. In the context of the present invention, any suitable perfume composition may be used. Those skilled in the art will recognize suitable compatible perfume raw materials for use in the perfume composition, and will know how to select combinations of ingredients to achieve desired scents.

Preferably, the level of dispersed perfume is at a level of from 0.1% to 10%, preferably 0.3% to 7.5%, more preferably from 0.5% to 5.0% by total weight of the composition.

The perfume composition may comprise from 2.5% to 30%, preferably from 5% to 30% by total weight of perfume composition of perfume raw materials characterized by a log P lower than 3.0, and a boiling point lower than 250° C.

The perfume composition may comprise from 5% to 30%, preferably from 7% to 25% by total weight of perfume composition of perfume raw materials characterized by having a log P lower than 3.0 and a boiling point higher than 250° C. The perfume composition may comprise from 35% to 60%, preferably from 40% to 55% by total weight of perfume composition of perfume raw materials characterized by having a log P higher than 3.0 and a boiling point lower than 250° C.

The perfume composition may comprise from 10% to 45%, preferably from 12% to 40% by total weight of perfume composition of perfume raw materials characterized by having a log P higher than 3.0 and a boiling point higher than 250° C.

Particles

The liquid fabric softener composition of the present invention may also comprise particles. The liquid fabric softener composition may comprise, based on the total liquid fabric softener composition weight, from 0.02% to 10%, preferably from 0.1% to 4%, more preferably from 0.25% to 2.5% of particles. Said particles include beads, pearlescent agents, benefit agent encapsulates, and mixtures thereof.

Encapsulated Benefit Agent:

The liquid fabric softener composition may comprise from 0.05% to 10%, preferably from 0.05% to 3.0%, more preferably from 0.05% to 2.0% by weight of encapsulated benefit agent. The benefit agent is selected from the group consisting of perfume composition, moisturizers, a heating or cooling agent, an insect/moth repellent, germ/mould/mildew control agents, softening agents, antistatic agents, anti-allergenic agents, UV protection agents, sun fade inhibitors, hueing dyes, enzymes and combinations thereof, color protection agents such as dye transfer inhibitors, bleach agents, and combinations thereof. Perfume compositions are preferred benefit agents.

The benefit agent is encapsulated, for instance, as part of a core in one or more capsules. Such cores can comprise other materials, such as diluents, solvents and density balancing agents.

The capsules have a wall, which at least partially, preferably fully surrounds the benefit agent comprising core. The capsule wall material may be selected from the group consisting of melamine, polyacrylamide, silicones, silica, polystyrene, polyurea, polyurethanes, polyacrylate based materials, polyacrylate esters based materials, gelatin, styrene malic anhydride, polyamides, aromatic alcohols, polyvinyl alcohol, resorcinol-based materials, poly-isocyanate-based materials, acetals (such as 1,3,5-triol-benzenegluteraldehyde and 1,3,5-triol-benzene melamine), starch, cellulose acetate phthalate and mixtures thereof.

Preferably, the capsule wall comprises one or more wall material comprising melamine, polyacrylate based material and combinations thereof.

Said melamine wall material may be selected from the group consisting of melamine crosslinked with formaldehyde, melamine-dimethoxyethanol crosslinked with formaldehyde, and combinations thereof.

Said polyacrylate based material may be selected from the group consisting of polyacrylate formed from methylmethacrylate/dimethylaminomethyl methacrylate, polyacrylate formed from amine acrylate and/or methacrylate and strong acid, polyacrylate formed from carboxylic acid acrylate and/or methacrylate monomer and strong base, polyacrylate formed from an amine acrylate and/or methacrylate monomer and a carboxylic acid acrylate and/or carboxylic acid methacrylate monomer and combinations thereof.

Said polystyrene wall material may be selected from polyestyrene cross-linked with divinylbenzene.

Polyurea capsules can comprise a polyurea wall which is the reaction product of the polymerisation between at least one polyisocyanate comprising at least two isocyanate functional groups and at least one amine, preferably a polyfunctional amine as a cross-linking and a colloidal stabilizer.

Polyurethane capsules can comprise a polyureathane wall which is the reaction product of a polyfunctional isocyanate and a polyfunctional alcohol as a cross-linking agent and a colloidal stabilizer.

Suitable capsules can be obtained from Encapsys (Appleton, Wis., USA). The fabric softener compositions may comprise combinations of different capsules, for example capsules having different wall materials and/or benefit agents.

As mentioned earlier, perfume compositions are the preferred encapsulated benefit agent. The perfume composition comprises perfume raw materials. The perfume composition can further comprise essential oils, malodour reducing agents, odour controlling agents and combinations thereof.

The perfume raw materials are typically present in an amount of from 10% to 95%, preferably from 20% to 90% by weight of the capsule.

The perfume composition may comprise from 2.5% to 30%, preferably from 5% to 30% by total weight of perfume composition of perfume raw materials characterized by a log P lower than 3.0, and a boiling point lower than 250° C.

The perfume composition may comprise from 5% to 30%, preferably from 7% to 25% by total weight of perfume composition of perfume raw materials characterized by having a log P lower than 3.0 and a boiling point higher than 250° C. The perfume composition may comprise from 35% to 60%, preferably from 40% to 55% by total weight of perfume composition of perfume raw materials characterized by having a log P higher than 3.0 and a boiling point lower than 250° C. The perfume composition may comprise from 10% to 45%, preferably from 12% to 40% by total weight of perfume composition of perfume raw materials characterized by having a log P higher than 3.0 and a boiling point higher than 250° C.

Ratio of Encapsulated Benefit Agent to Dispersed Perfume Oil

The liquid fabric softener composition may comprise a ratio of perfume oil encapsulates to freely dispersed perfume oil of from 1:1 to 1:40, preferably from 1:2 to 1:20, more preferably from 1:3 to 1:10.

Additional Fabric Softening Active

The liquid fabric softener composition of the present invention may comprise from 0.01% to 10%, preferably from 0.1% to 10%, more preferably from 0.1% to 5% of additional fabric softening active. Suitable fabric softening actives, include, but are not limited to, materials selected from the group consisting of non-ester quaternary ammonium compounds, amines, fatty esters, sucrose esters, silicones, dispersible polyolefins, polysaccharides, fatty acids, softening oils, polymer latexes and combinations thereof.

Non-Ester Quaternary Ammonium Compounds:

Suitable non-ester quaternary ammonium compounds comprise compounds of the formula:

$$[R_{(4-m)}—N^{+}—R^{1}_{m}]X^{-}$$

wherein each R comprises either hydrogen, a short chain $C_1$-$C_6$, in one aspect a $C_1$-$C_3$ alkyl or hydroxyalkyl group, for example methyl, ethyl, propyl, hydroxyethyl, poly($C_{2-3}$ alkoxy), polyethoxy, benzyl, or mixtures thereof; each m is 1, 2 or 3 with the proviso that the value of each m is the same; the sum of carbons in each $R^1$ may be $C_{12}$-$C_{22}$, with each $R^1$ being a hydrocarbyl, or substituted hydrocarbyl group; and $X^-$ may comprise any softener-compatible anion. The softener-compatible anion may comprise chloride, bromide, methylsulfate, ethylsulfate, sulfate, and nitrate. The softener-compatible anion may comprise chloride or methyl sulfate.

Non-limiting examples include dialkylenedimethylammonium salts such as dicanoladimethylammonium chloride, di(hard)tallowdimethylammonium chloride dicanoladimethylammonium methylsulfate, and mixtures thereof. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

Amines:

Suitable amines include but are not limited to, materials selected from the group consisting of amidoesteramines, amidoamines, imidazoline amines, alkyl amines, and combinations thereof. Suitable ester amines include but are not limited to, materials selected from the group consisting of monoester amines, diester amines, triester amines and combinations thereof. Suitable amidoamines include but are not limited to, materials selected from the group consisting of monoamido amines, diamido amines and combinations thereof. Suitable alkyl amines include but are not limited to, materials selected from the group consisting of mono alkylamines, dialkyl amines quats, trialkyl amines, and combinations thereof.

Fatty Acid:

The liquid fabric softener composition may comprise a fatty acid, such as a free fatty acid as fabric softening active. The term "fatty acid" is used herein in the broadest sense to include unprotonated or protonated forms of a fatty acid. One skilled in the art will readily appreciate that the pH of an aqueous composition will dictate, in part, whether a fatty acid is protonated or unprotonated. The fatty acid may be in its unprotonated, or salt form, together with a counter ion, such as, but not limited to, calcium, magnesium, sodium, potassium, and the like. The term "free fatty acid" means a fatty acid that is not bound to another chemical moiety (covalently or otherwise).

The fatty acid may include those containing from 12 to 25, from 13 to 22, or even from 16 to 20, total carbon atoms, with the fatty moiety containing from 10 to 22, from 12 to 18, or even from 14 (mid-cut) to 18 carbon atoms.

The fatty acids may be derived from (1) an animal fat, and/or a partially hydrogenated animal fat, such as beef tallow, lard, etc.; (2) a vegetable oil, and/or a partially hydrogenated vegetable oil such as canola oil, safflower oil, peanut oil, sunflower oil, sesame seed oil, rapeseed oil, cottonseed oil, corn oil, soybean oil, tall oil, rice bran oil, palm oil, palm kernel oil, coconut oil, other tropical palm oils, linseed oil, tung oil, castor oil, etc.; (3) processed and/or bodied oils, such as linseed oil or tung oil via thermal, pressure, alkali-isomerization and catalytic treatments; (4) combinations thereof, to yield saturated (e.g. stearic acid), unsaturated (e.g. oleic acid), polyunsaturated (linoleic acid), branched (e.g. isostearic acid) or cyclic (e.g. saturated or unsaturated α-disubstituted cyclopentyl or cyclohexyl derivatives of polyunsaturated acids) fatty acids.

Mixtures of fatty acids from different fat sources can be used.

The cis/trans ratio for the unsaturated fatty acids may be important, with the cis/trans ratio (of the C18:1 material) being from at least 1:1, at least 3:1, from 4:1 or even from 9:1 or higher.

Branched fatty acids such as isostearic acid are also suitable since they may be more stable with respect to oxidation and the resulting degradation of color and odor quality.

The fatty acid may have an iodine value from 0 to 140, from 50 to 120 or even from 85 to 105.

Polysaccharides:

The liquid fabric softener composition may comprise a polysaccharide as a fabric softening active, such as cationic starch. Suitable cationic starches for use in the present compositions are commercially-available from Cerestar under the trade name C*BOND® and from National Starch and Chemical Company under the trade name CATO® 2A.

Sucrose Esters:

The liquid fabric softener composition may comprise a sucrose esters as a fabric softening active. Sucrose esters are typically derived from sucrose and fatty acids. Sucrose ester is composed of a sucrose moiety having one or more of its hydroxyl groups esterified.

Sucrose is a disaccharide having the following formula:

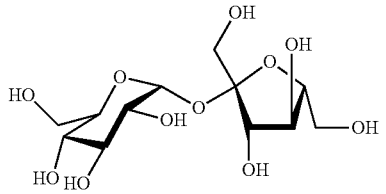

Alternatively, the sucrose molecule can be represented by the formula: $M(OH)_8$, wherein M is the disaccharide backbone and there are total of 8 hydroxyl groups in the molecule.

Thus, sucrose esters can be represented by the following formula:

$$M(OH)_{8-x}(OC(O)R^1)_x$$

wherein x is the number of hydroxyl groups that are esterified, whereas (8-x) is the hydroxyl groups that remain unchanged; x is an integer selected from 1 to 8, alternatively from 2 to 8, alternatively from 3 to 8, or from 4 to 8; and $R^1$ moieties are independently selected from $C_1$-$C_{22}$ alkyl or $C_1$-$C_{30}$ alkoxy, linear or branched, cyclic or acyclic, saturated or unsaturated, substituted or unsubstituted.

The $R^1$ moieties may comprise linear alkyl or alkoxy moieties having independently selected and varying chain length. For example, $R^1$ may comprise a mixture of linear alkyl or alkoxy moieties wherein greater than 20% of the linear chains are $C_{18}$, alternatively greater than 50% of the linear chains are $C_{18}$, alternatively greater than 80% of the linear chains are $C_{18}$.

The $R^1$ moieties may comprise a mixture of saturate and unsaturated alkyl or alkoxy moieties. The iodine value (IV) of the sucrose esters suitable for use herein ranges from 1 to 150, or from 2 to 100, or from 5 to 85. The $R^1$ moieties may be hydrogenated to reduce the degree of unsaturation. In the case where a higher IV is preferred, such as from 40 to 95, then oleic acid and fatty acids derived from soybean oil and canola oil are suitable starting materials.

The unsaturated $R^1$ moieties may comprise a mixture of "cis" and "trans" forms the unsaturated sites. The "cis"/"trans" ratios may range from 1:1 to 50:1, or from 2:1 to 40:1, or from 3:1 to 30:1, or from 4:1 to 20:1.

Dispersible Polyolefins and latexes:

Generally, all dispersible polyolefins that provide fabric softening benefits can be used as fabric softening active in the present invention. The polyolefins can be in the form of waxes, emulsions, dispersions or suspensions.

The polyolefin may be chosen from a polyethylene, polypropylene, or combinations thereof. The polyolefin may be at least partially modified to contain various functional groups, such as carboxyl, alkylamide, sulfonic acid or amide groups. The polyolefin may be at least partially carboxyl modified or, in other words, oxidized.

Non-limiting examples of fabric softening active include dispersible polyethylene and polymer latexes. These agents can be in the form of emulsions, latexes, dispersions, suspensions, and the like. In one aspect, they are in the form of an emulsion or a latex. Dispersible polyethylenes and polymer latexes can have a wide range of particle size diameters ($\chi_{50}$) including but not limited to from 1 nm to 100 μm; alternatively from 10 nm to 10 μm. As such, the particle sizes of dispersible polyethylenes and polymer latexes are generally, but without limitation, smaller than silicones or other fatty oils.

Generally, any surfactant suitable for making polymer emulsions or emulsion polymerizations of polymer latexes can be used as emulsifiers for polymer emulsions and latexes used as fabric softeners active in the present invention. Suitable surfactants include anionic, cationic, and nonionic surfactants, and combinations thereof. In one aspect, such surfactants are nonionic and/or anionic surfactants. In one aspect, the ratio of surfactant to polymer in the fabric softening active is 1:5, respectively.

Silicone:

The liquid fabric softener composition may comprise a silicone as fabric softening active. Useful silicones can be any silicone comprising compound. The silicone polymer may be selected from the group consisting of cyclic silicones, polydimethylsiloxanes, aminosilicones, cationic silicones, silicone polyethers, silicone resins, silicone urethanes, and combinations thereof. The silicone may be a polydialkylsilicone, alternatively a polydimethyl silicone (polydimethyl siloxane or "PDMS"), or a derivative thereof. The silicone may be chosen from an aminofunctional silicone, amino-polyether silicone, alkyloxylated silicone, cationic silicone, ethoxylated silicone, propoxylated silicone, ethoxylated/propoxylated silicone, quaternary silicone, or combinations thereof.

Nonionic Surfactants

The composition may comprise, based on the total liquid fabric softener composition weight, from 0.01% to 10% of a nonionic surfactant, preferably ethoxylated nonionic surfactant, more preferably an ethoxylated nonionic surfactant having a hydrophobic lipophilic balance value of 8 to 18. Non-ionic surfactants help to effectively disperse perfume into the fabric softener composition.

Examples of suitable nonionic surfactants are commercially available from BASF under the tradename Lutensol AT80 (ethoxylated alcohol with an average degree of ethoxylation of 80 from BASF), from Clariant under the tradename Genapol T680 (ethoxylated alcohol with an average degree of ethoxylation of 68), from Sigma Aldrich under the tradename Tween 20 (polysorbate with an average degree of ethoxylation of 20).

Further Perfume Delivery Technologies

The liquid fabric softener composition may comprise one or more perfume delivery technologies that stabilize and enhance the deposition and release of perfume ingredients from treated substrate. Such perfume delivery technologies can be used to increase the longevity of perfume release from the treated substrate. Perfume delivery technologies, methods of making certain perfume delivery technologies and the uses of such perfume delivery technologies are disclosed in US 2007/0275866 A1.

The liquid fabric softener composition may comprise from 0.001% to 20%, or from 0.01% to 10%, or from 0.05% to 5%, or even from 0.1% to 0.5% by weight of the perfume delivery technology. Said perfume delivery technologies may be selected from the group consisting of: pro-perfumes, cyclodextrins, starch encapsulated accord, zeolite and inorganic carrier, and combinations thereof.

Amine Reaction Product (ARP): For purposes of the present application, ARP is a subclass or species of pro-perfumes. One may also use "reactive" polymeric amines in which the amine functionality is pre-reacted with one or more PRMs to form an amine reaction product (ARP). Typically the reactive amines are primary and/or secondary amines, and may be part of a polymer or a monomer (non-polymer). Such ARPs may also be mixed with additional PRMs to provide benefits of polymer-assisted delivery and/or amine-assisted delivery. Nonlimiting examples of polymeric amines include polymers based on polyalkylimines, such as polyethyleneimine (PEI), or polyvinylamine (PVAm). Nonlimiting examples of monomeric (non-polymeric) amines include hydroxyl amines, such as 2-aminoethanol and its alkyl substituted derivatives, and aromatic amines such as anthranilates. The ARPs may be premixed with perfume or added separately in leave-on or rinse-off applications. A material that contains a heteroatom other than nitrogen, for example oxygen, sulfur, phosphorus or selenium, may be used as an alternative to amine compounds. The aforementioned alternative compounds can be used in combinations with amine compounds. A single molecule may comprise an amine moiety and one or more of the alternative heteroatom moieties, for example, thiols, and phosphines. The benefit may include improved delivery of perfume as well as controlled perfume release.

Deposition Aid

The liquid fabric softener composition may comprise, based on the total liquid fabric softener composition weight, from 0.0001% to 3%, preferably from 0.0005% to 2%, more preferably from 0.001% to 1% of a deposition aid. The deposition aid may be a cationic or amphoteric polymer. The cationic polymer may comprise a cationic acrylate. Cationic polymers in general and their method of manufacture are known in the literature. Deposition aids can be added concomitantly with particles or directly in the liquid fabric softener composition. Preferably, the deposition aid is selected from the group consisting of polyvinylformamide, partially hydroxylated polyvinylformamide, polyvinylamine, polyethylene imine, ethoxylated polyethylene imine, polyvinylalcohol, polyacrylates, and combinations thereof.

The weight-average molecular weight of the polymer may be from 500 to 5000000 or from 1000 to 2000000 or from 2500 to 1500000 Dalton, as determined by size exclusion chromatography relative to polyethyleneoxide standards using Refractive Index (RI) detection. In one aspect, the weight-average molecular weight of the cationic polymer may be from 500 to 37500 Dalton.

METHODS

Method of Determining pH of a Fabric Softener Composition

The pH is measured on the neat fabric softener composition, using a Sartorius PT-10P pH meter with gel-filled probe (such as the Toledo probe, part number 52 000 100), calibrated according to the instructions manual.

Method of Determining Viscosity of a Fabric Softener Composition

The viscosity of neat fabric softener composition is determined using a Brookfield DV-E rotational viscometer, at 60 rpm, at 20-21° C. Spindle 2 is used for viscosities from 50 mPa·s to 400 mPa·s. Spindle 3 is used for viscosities from 400 mPa·s to 2.0 Pa·s.

Method for Determining Dynamic Yield Stress

Dynamic yield stress is measured using a controlled stress rheometer (such as an HAAKE MARS from Thermo Scientific, or equivalent), using a 60 mm parallel plate and a gap size of 500 microns at 20° C. The dynamic yield stress is obtained by measuring quasi steady state shear stress as a function of shear rate in the range of 10 $s^{-1}$ to $10^{-4}$ $s^{-1}$, taking 25 points logarithmically distributed over the shear rate range. Quasi-steady state is defined as the shear stress value once variation of shear stress over time is less than 3%, after at least 30 seconds and a maximum of 60 seconds at a given shear rate. Variation of shear stress over time is continuously evaluated by comparison of the average shear stress measured over periods of 3 seconds. If after 60 seconds measurement at a certain shear rate, the shear stress value varies more than 3%, the final shear stress measurement is defined as the quasi state value for calculation purposes. Shear stress data is then fitted using least squares method in log space as a function of shear rate following a Herschel-Bulkley model:

$$\tau=\tau_0+k\dot{\gamma}^n$$

wherein $\tau$ is the measured equilibrium quasi steady state shear stress at each applied shear rate, $\tau_0$ is the fitted dynamic yield stress, and $\dot{\gamma}$ the applied shear rate. k and n are fitting parameters.

Method of Measuring Iodine Value of a Quaternary Ammonium Ester Fabric Softening Active:

The iodine value ("IV") of a quaternary ammonium ester fabric softening active is the iodine value of the parent fatty acid from which the fabric softening active is formed, and is defined as the number of grams of iodine which react with 100 grams of parent fatty acid from which the fabric softening active is formed.

First, the quaternary ammonium ester fabric softening active is hydrolysed according to the following protocol: 25 g of fabric softener composition is mixed with 50 mL of water and 0.3 mL of sodium hydroxide (50% activity). This mixture is boiled for at least an hour on a hotplate while avoiding that the mixture dries out. After an hour, the mixture is allowed to cool down and the pH is adjusted to neutral (pH between 6 and 8) with sulfuric acid 25% using pH strips or a calibrated pH electrode.

Next the fatty acid is extracted from the mixture via acidified liquid-liquid extraction with hexane or petroleum ether: The sample mixture is diluted with water/ethanol (1:1) to 160 mL in an extraction cylinder, 5 grams of sodium chloride, 0.3 mL of sulfuric acid (25% activity) and 50 mL of hexane are added. The cylinder is stoppered and shaken for at least 1 minute. Next, the cylinder is left to rest until 2 layers are formed. The top layer containing the fatty acid in hexane is transferred to another recipient. The hexane is then evaporated using a hotplate leaving behind the extracted fatty acid.

Next, the iodine value of the parent fatty acid from which the fabric softening active is formed is determined following IS03961:2013. The method for calculating the iodine value of a parent fatty acid comprises dissolving a prescribed amount (from 0.1-3 g) into 15 mL of chloroform. The dissolved parent fatty acid is then reacted with 25 mL of iodine monochloride in acetic acid solution (0.1M). To this, 20 mL of 10% potassium iodide solution and 150 mL deionised water is added. After the addition of the halogen has taken place, the excess of iodine monochloride is determined by titration with sodium thiosulphate solution (0.1M) in the presence of a blue starch indicator powder. At the same time a blank is determined with the same quantity of reagents and under the same conditions. The difference between the volume of sodium thiosulphate used in the blank and that used in the reaction with the parent fatty acid enables the iodine value to be calculated.

Method for Determining Average Cellulose Fiber Diameter:

The average cellulose fiber diameter can be determined directly from the cellulose fiber raw material or from the fabric softener composition comprising cellulose fibers.

A) Cellulose fibers raw material: A cellulose fibers sample is prepared by adding 1% dry matter of cellulose fibers to water and activating it with a high pressure homogenizer (PANDA from GEA, 350 bars, 10 passes). Obtained sample is analyzed.

B) Fabric softener composition comprising cellulose fibers:

The fabric softener composition sample is centrifuged at 4,000 rpm for 10 minutes using a 5804 centrifuge from Eppendorf, in order to remove potential particles to avoid interference in the measurement of the fiber size. The clarified fabric softener composition is then decanted as the supernatant. The cellulose fibers present in the fabric softener composition (supernatant) are redispersed in ethanol using an Ultra Turrax device from IKA, T25 S 25 N-25 G-ST, at a speed of 21,000 rpm for 10 minutes. Then, sample is centrifuged at 4,000 rpm for 10 minutes using a 5804 centrifuge from Eppendorf and supernatant is removed. Remaining cellulose fibers at the bottom are analyzed. Repeat the process as many times as needed to have enough amount for the analysis.

Average cellulose fiber diameter is analysed using Atomic force microscopy (AFM). A 0.02% cellulose fiber dispersion in demineralized water is prepared, and a drop of this dispersion is deposited onto freshly cleaved mica (highest grade V1 Mica, 15×15 mm—TED PELLA, INC., or equivalent). The sample is then allowed to dry in an oven at 40° C.

The mica sheet is mounted in an AFM (Nanosurf Flex AFM, ST Instruments or equivalent) and imaged in air under ambient conditions using a Si cantilever in dynamic mode with dynamic mode tip (ACTA-50-APPNANO or equivalent). The image dimensions are 20 micron by 20 micron, and 256 points per line are captured.

The AFM image is opened using suitable AFM data analysis software (such as Mountainsmap SPM 7.3, ST Instruments, or equivalent). Each image is leveled line by line. One or more profiles are extracted crossing perpendicularly one or multiple fibers avoiding bundles of fibers, and from each profile, a distance measurement is performed to obtain the diameter of the fibers. Ten diameter measurements are performed per picture counting each fiber only once.

Three sets of measurements (sample preparation, AFM measurement and image analysis) are made. The arithmetic mean of all fibers measured in all images is the Average Cellulose Fiber Diameter.

Method of Determining Partition Coefficient

The partition coefficient, P, is the ratio of concentrations of a compound in a mixture of two immiscible phases at equilibrium, in this case n-Octanol/Water. The value of the log of the n-Octanol/Water Partition Coefficient (log P) can be measured experimentally using well known means, such as the "shake-flask" method, measuring the distribution of the solute by UV/VIS spectroscopy (for example, as described in "The Measurement of Partition Coefficients", Molecular Informatics, Volume 7, Issue 3, 1988, Pages 133-144, by Dearden JC, Bresnan). Alternatively, the log P can be computed for each PRM in the perfume mixture being tested. The log P of an individual PRM is preferably calculated using the Consensus log P Computational Model, version 14.02 (Linux) available from Advanced Chemistry Development Inc. (ACD/Labs) (Toronto, Canada) to provide the unitless log P value. The ACD/Labs' Consensus log P Computational Model is part of the ACD/Labs model suite.

Processes of Making the Fabric softener composition of the invention

The compositions of the present invention can be formulated into any suitable form and prepared by any process chosen by the formulator, non-limiting examples of which are described in Applicant's examples and in US 2013/0109612 A1 which is incorporated herein by reference.

The compositions disclosed herein may be prepared by combining the components thereof in any convenient order and by mixing, e.g., agitating, the resulting component combination to form a phase stable fabric care composition. A fluid matrix may be formed containing at least a major proportion, or even substantially all, of the fluid components with the fluid components being thoroughly admixed by imparting shear agitation to this liquid combination. For example, rapid stirring with a mechanical stirrer may be employed.

Figure 2:
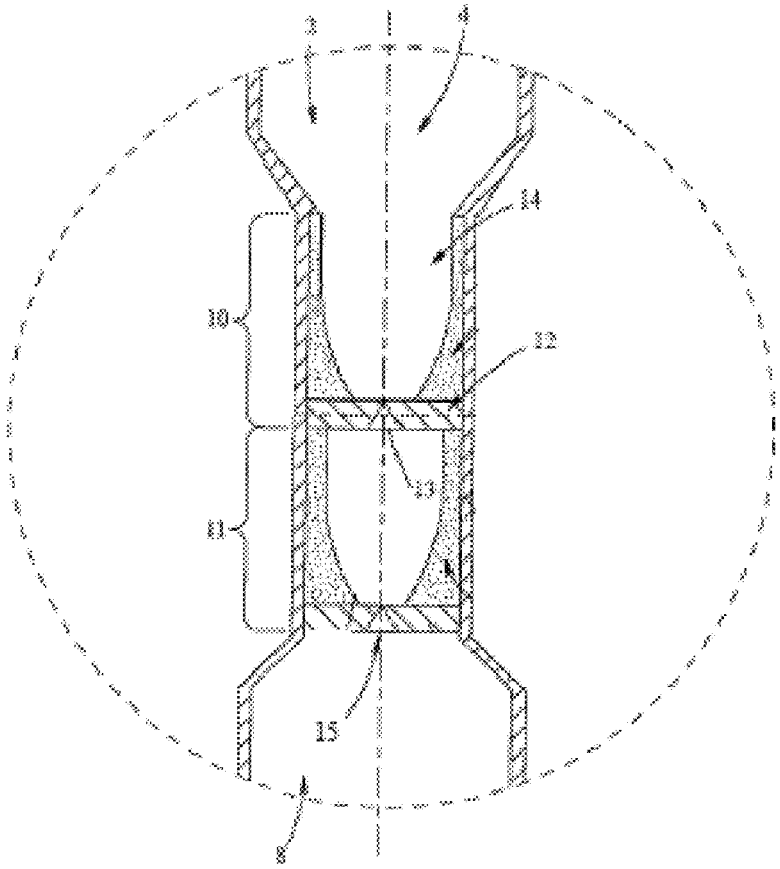
FIG. 2 details the orifice component 5 of Apparatus A (see Methods).

The liquid fabric softener compositions described herein can also be made as follows:

Taking an apparatus A (see FIG. 1) comprising:

at least a first inlet 1A and a second inlet 1B; a pre-mixing chamber 2, the pre-mixing chamber 2 having an upstream end 3 and a downstream end 4, the upstream end 3 of the pre-mixing chamber 2 being in liquid communication with the first inlet 1A and the second inlet 1B; an orifice component 5, the orifice component 5 having an upstream end 6 and a downstream end 7, the upstream end of the orifice component 6 being in liquid communication with the downstream end 4 of the pre-mixing chamber 2, wherein the orifice component 5 is configured to spray liquid in a jet and produce shear and/or turbulence in the liquid; a secondary mixing chamber 8, the secondary mixing chamber 8 being in liquid communication with the downstream end 7 of the orifice component 5; at least one outlet 9 in liquid communication with the secondary mixing chamber 8 for discharge of liquid following the production of shear and/or turbulence in the liquid, the inlet 1A, pre-mixing chamber 2, the orifice component 5 and secondary mixing chamber 8 are linear and in straight line with each other, at least one outlet 9 being located at the downstream end of the secondary mixing chamber 8; the orifice component 5 comprising at least one orifice unit, a specific example, as shown in FIG. 2, is that the orifice component 5 comprises two orifice units 10 and 11 arranged in series to one another and each orifice unit comprises an orifice plate 12 comprising at least one orifice 13, an orifice chamber 14 located upstream from the orifice plate 12 and in liquid communication with the orifice plate 12; and wherein neighboring orifice plates are distinct from each other;

connecting one or more suitable liquid pumping devices to the first inlet 1A and to the second inlet 1B;

pumping a second liquid composition into the first inlet 1A, and, pumping a liquid fabric softener active composition into the second inlet 1B, wherein the operating pressure of the apparatus is from 2.5 bar to 50 bar, from 3.0 bar to 20 or from 3.5 bar to 10 bar the operating pressure being the pressure of the liquid as measured in the first inlet 1A near to inlet 1B. The operating pressure at the outlet of apparatus A needs to be high enough to prevent cavitation in the orifice;

allowing the liquid fabric softener active and the second liquid composition to pass through the apparatus A at a desired flow rate, wherein as they pass through the apparatus A, they are dispersed one into the other, herein, defined as a liquid fabric softener intermediate.

passing said liquid fabric softener intermediate from Apparatus A's outlet, to Apparatus B's (FIG. 3) inlet 16 to subject the liquid fabric softener intermediate to additional shear and/or turbulence for a period of time within Apparatus B.

circulating said liquid fabric softener intermediate within apparatus B with a circulation Loop pump 17 at a Circulation Loop 18 Flow Rate equal to or greater than said inlet liquid fabric softener intermediate flow rate in said Circulation Loop System. A tank, with or without a recirculation loop, or a long conduit may also be employed to deliver the desired shear and/or turbulence for the desired time.

adding by means of a pump 19, piping and in-line fluid injector 20, an adjunct fluid, in one aspect, but not limited to a dilute salt solution, into Apparatus B to mix with the liquid fabric softener intermediate allowing the liquid fabric softener composition with the desired microstructure to exit Apparatus B 21 at a rate equal to the inlet flow rate into Apparatus B.

passing said liquid fabric softener composition exiting Apparatus B outlet through a heat exchanger to be cooled to ambient temperature, if necessary.

discharging the resultant liquid fabric softener composition produced out of the outlet of the process.

The process comprises introducing, in the form of separate streams, the fabric softener active in a liquid form and a second liquid composition comprising other components of a fabric softener composition into the pre-mixing chamber 2 of Apparatus A so that the liquids pass through the orifice component 5. The fabric softener active in a liquid form and the second liquid composition pass through the orifice component 5 under pressure. The fabric softener active in liquid form and the second liquid composition can be at the same or different operating pressures. The orifice component 5 is configured, either alone, or in combination with some other component, to mix the liquid fabric softener active and the second liquid composition and/or produce shear and/or turbulence in each liquid, or the mixture of the liquids.

The liquids can be supplied to the apparatus A and B in any suitable manner including, but not limited to through the use of pumps and motors powering the same. The pumps can supply the liquids to the apparatus A under the desired operating pressure. In one embodiment, an '8 frame block-style manifold' is used with a 781 type Plunger pump available from CAT pumps (1681 94th Lane NE, Minneapolis, Minn. 55449).

The operating pressure of conventional shear and/or turbulence apparatuses is typically between 2 bar and 490 bar. The operating pressure is the pressure of the liquid in the inlet 1A near inlet 1B. The operating pressure is provided by the pumps.

The operating pressure of Apparatus A is measured using a Cerphant T PTP35 pressure switch with a RVS membrane, manufactured by Endress Hauser (Endress+Hauser Instruments, International AG, Kaegenstrasse 2, CH-4153, Reinach). The switch is connected with the inlet 1A near inlet 1B using a conventional thread connection (male thread in the pre-mix chamber housing, female thread on the Cerphant T PTP35 pressure switch).

The operating pressure of Apparatus A may be lower than conventional shear and/or turbulence processes, yet the same degree of liquid mixing is achievable as seen with processes using conventional apparatuses. Also, at the same operating pressures, the process of the present invention results in better mixing than is seen with conventional shear and/orturbulence processes.

As the fabric softener active and the second liquid composition flow through the Apparatus A, they pass through the orifices 13 and 15 of the orifice component 5. As they do, they exit the orifice 13 and/or 15 in the form of a jet. This jet produces shear and/or turbulence in the fabric softener active and the second liquid composition, thus dispersing them one in the other to form a uniform mixture.

In conventional shear and/or turbulence processes, the fact that the liquids are forced through the orifice 13 and/or 15 under high pressure causes them to mix. This same degree of mixing is achievable at lower pressures when the liquids are forced through a series of orifices, rather than one at a high pressure. Also, at equivalent pressures, the process of the present invention results in better liquid mixing than shear and/or turbulence processes, due to the fact that the liquids are now forced through a series of orifices.

A given volume of liquid can have any suitable residence time and/or residence time distribution within the apparatus A. Some suitable residence times include, but are not limited to from 1 microsecond to 1 second, or more. The liquid(s) can flow at any suitable flow rate through the apparatus A. Suitable flow rates range from 1 to 1 500 L/min, or more, or any narrower range of flow rates falling within such range including, but not limited to from 5 to 1 000 L/min.

For Apparatus B Circulating Loop System example, one may find it convenient to characterize the circulation flow by a Circulation Loop Flow Rate Ratio which is equal to the Circulation Flow Rate divided by the Inlet Flow Rate. Said Circulation Loop Flow Rate Ratio for producing the desired fabric softener composition microstructure can be from 1 to 100, from 1 to 50, and even from 1 to 20. The fluid flow in the circulation loop imparts shear and turbulence to the liquid fabric softener to transform the liquid fabric softener intermediate into a desired dispersion microstructure.

The duration of time said liquid fabric softener intermediate spends in said Apparatus B may be quantified by a Residence Time equal to the total volume of said Circulation Loop System divided by said fabric softener intermediate inlet flow rate. Said Circulation Loop Residence Time for producing desirable liquid fabric softener composition microstructures may be from 0.1 seconds to 10 minutes, from 1 second to 1 minute, or from 2 seconds to 30 seconds. It is desirable to minimize the residence time distribution.

Shear and/or turbulence imparted to said liquid fabric softener intermediate may be quantified by estimating the total kinetic energy per unit fluid volume. The kinetic energy per unit volume imparted in the Circulation Loop System to the fabric softener intermediate in Apparatus B may be from 10 to 1 000 000 $g \cdot cm^{-1} \cdot s^{-2}$, from 50 to 500 000 $g \cdot cm^{-1} \cdot s^{-2}$, or from 100 to 100 000 $g \cdot cm^{-1} \cdot s^{-2}$. The liquid(s) flowing through Apparatus B can flow at any suitable flow rate. Suitable inlet and outlet flow rates range from 1 to 1 500 L/min, or more, or any narrower range of flow rates falling within such range including, but not limited to from 5 to 1 000 L/min. Suitable Circulation Flow Rates range from 1 L/min to 20 000 L/min or more, or any narrower range of flow rates falling within such range including but not limited to from 5 to 10 000 L/min. Apparatus A is ideally operated at the same time as Apparatus B to create a continuous process. The liquid fabric softener intermediate created in Apparatus A may also be stored in a suitable vessel and processed through apparatus B at a later time.

EXAMPLES

The liquid fabric softener starting compositions A to G were prepared by first preparing dispersions of the quaternary ammonium ester softener active ("FSA") using apparatus A and B in a continuous fluid making process with 3 orifices. Coconut oil and isopropanol were added to the hot FSA at 81° C. to form an FSA premix. Heated FSA premix at 81° C. and heated deionized water at 65° C. containing adjunct materials NaHEDP, HCl, Formic Acid, and the preservative were fed using positive displacement pumps, through Apparatus A, through apparatus B, a circulation loop fitted with a centrifugal pump. The liquid fabric softener starting composition was immediately cooled to 25° C. with a plate heat exchanger. The total flow rate was 3.1 kg/min; pressure at Apparatus A Inlet 5 bar; pressure at Apparatus A Outlet 2.5 bar; Apparatus B Circulation Loop Flow rate Ratio 8.4; Apparatus B Kinetic Energy 18 000 $g \cdot cm^{-1} \cdot s^{-2}$; Apparatus B Residence Time 14 s; Apparatus B Outlet pressure 3 bar.

The fabric softener starting compositions are finished by adding the remaining ingredients provided in Table 1 below using a Ytron-Y high speed mixer operated at 20 Hz for 15-20 minutes. Table 1 shows the overall composition of fabric softener starting compositions A to G. In examples E to G, a premix comprising 3% microfibrous cellulose was added in a last step to the liquid fabric softener composition using a Silverson Homogenizer LSM, operating at 4 500 rpm for 5 min, to achieve a homogeneous dispersion. The preparation of the 3% premix comprising the microfibrous cellulose was obtained by mixing the 10% aqueous cellulose fiber paste as obtained from the supplier in the non-thickened liquid fabric softener composition with an IKA Ultra Turrax high shear mixer for 10 min at 21 500 rpm.

TABLE 1

Liquid fabric softener starting compositions A to G.

| | Weight % | | | | | | |
|---|---|---|---|---|---|---|---|
| | A | B | C | D | E | F | G |
| Deionized water | Balance | Balance | Balance | Balance | Balance | Balance | Balance |
| NaHEDP | 0.007 | 0.007 | 0.007 | 0.007 | 0.007 | 0.007 | 0.007 |
| Formic acid | 0.044 | 0.044 | 0.044 | 0.043 | 0.043 | 0.043 | 0.043 |
| HCl | 0.009 | 0.009 | 0.009 | 0.009 | 0.009 | 0.009 | 0.009 |
| Preservative[a] | 0.022 | 0.022 | 0.022 | 0.021 | 0.021 | 0.021 | 0.021 |
| FSA[b] | 7.6 | 7.6 | 7.6 | 7.4 | 7.3 | 7.3 | 7.3 |
| Antifoam[c] | 0.1 | 0.1 | 0.1 | 0.1 | 0.1 | 0.1 | 0.1 |
| coconut oil | 0.26 | 0.26 | 0.26 | 0.25 | 0.25 | 0.25 | 0.25 |
| isopropanol | 0.78 | 0.77 | 0.77 | 0.76 | 0.75 | 0.75 | 0.75 |
| Encapsulated perfume[d] | 0.15 | 0.15 | 0.15 | 0.15 | 0.15 | 0.15 | 0.15 |
| Dye | 0.015 | 0.015 | 0.015 | 0.015 | 0.015 | 0.015 | 0.015 |
| Cationic polymeric thickener[e] | 0.20 | 0.28 | 0.35 | 0.00 | 0.00 | 0.00 | 0.00 |
| Cellulose fibers[f] | 0 | 0 | 0 | 0.27 | 0.34 | 0.36 | 0.35 |
| Perfume | 1 | 1 | 1 | 1 | 1 | 1 | 1 |
| pH | 3.01 | 3.00 | 3.02 | 3.00 | 2.96 | 3.00 | NA |
| Dynamic yield stress [Pa] | 0.09 | 0.38 | 0.38 | 0.11 | 0.20 | 0.23 | NA |
| Initial viscosity [mPa · s][g] | 251 | 392 | 608 | 323 | 458 | 648 | 410 |

[a]Proxel GXL, 20% aqueous dipropylene glycol solution of 1,2-benzisothiazolin-3-one, supplied by Lonza.

[b]N,N-bis(hydroxyethyl)-N,N-dimethyl ammonium chloride fatty acid ester. The iodine value of the parent fatty acid of this material is between 18 and 22. The material as obtained from Evonik contains impurities in the form of free fatty acid, the monoester form of N,N-bis(hydroxyethyl)-N,N-dimethyl ammonium chloride fatty acid ester, and fatty acid esters of N,N-bis(hydroxyethyl)-N-methylamine.

[c]MP10 ®, supplied by Dow Corning, 8% activity

[d]as described in U.S. Pat. No. 8,940,395, expressed as 100% encapsulated perfume oil

[e]Rheovis ® CDE, cationic polymeric thickener supplied by BASF

[f]Exilva ®, microfibrous cellulose, expressed as 100% dry matter, supplied by Borregaard as an aqueous 10% microfibrous cellulose dispersion.

[g]Brookfield ® DV-E viscosity at 60 rpm, measured at 21° C., 24 hours after making A 10% by weight solution of the cationic hydrotrope bis (2-hydroxyethyl) dimethylammonium chloride (supplied by Acros Organics) in water was prepared. Examples 1 to 6 in Table 2 below represent fabric softener compositions which were obtained by mixing the hydrotrope solution to the fabric softener starting compositions from Table 1. No aggregation or other phase instabilities were observed.

TABLE 2

Viscosity in mPa · s and relative viscosity decrease, as a percentage based on the initial viscosity, upon addition of the hydrotrope bis (2-hydroxyethyl) dimethylammonium chloride to the fabric softener starting compositions of Table 1. The hydrotrope concentration reflects the final concentration in parts per million after addition to the liquid fabric softener compositions of Table 1. The examples marked with an asterisk (*) are comparative examples.

| | hydrotrope | Ex. 1 a-c* | | Ex. 2 a-c* | | Ex. 3 a-c* | | Ex. 4 a-c | | Ex. 5 a-c | | Ex. 6 a-c | |
|---|---|---|---|---|---|---|---|---|---|---|---|---|---|
| | | Starting composition of Table 1 | | | | | | | | | | | |
| | concentration | A | | B | | C | | D | | E | | F | |
| a | 250 ppm | 122 | 51% | 202 | 48% | 297 | 51% | 265 | 18% | 410 | 10% | 568 | 12% |
| b | 500 ppm | 76 | 70% | 133 | 66% | 202 | 67% | 242 | 25% | 406 | 11% | 568 | 12% |
| c | 1000 ppm | 42 | 83% | 76 | 81% | 116 | 81% | 243 | 25% | 379 | 17% | 510 | 21% |

TABLE 3

Dynamic yield stress of the fabric softening compositions of Table 2 comprising 1000 ppm of hydrotrope bis (2-hydroxyethyl) dimethylammonium chloride. The examples marked with an asterisk (*) are comparative examples.

| | 1000 ppm hydrotrope | | | | | |
|---|---|---|---|---|---|---|
| | Ex. 1c* | Ex. 2c* | Ex. 3c* | Ex. 4c | Ex. 5c | Ex. 6c |
| Dynamic yield stress [Pa] | 0.000 | 0.002 | 0.01 | 0.07 | 0.11 | 0.11 |

From Table 2 it can be observed that comparative examples 1, 2, and 3 showed a decrease in viscosity upon addition of the hydrotrope to the thickened fabric softener compositions. Said decrease in viscosity was bigger with increasing level of the hydrotrope. Hence, to restore the original viscosity of the compositions to ensure phase stability, product richness perception, and pouring experience, an extra step of post adding extra rheology modifier would have been required. While starting compositions A, B, and C all had different initial viscosities ranging from 251 mPa·s to 608 mPa·s, the viscosity decrease upon addition of 1000 ppm hydrotrope was between 81% (Ex. 2c, Ex. 3c) and 83% (Ex. 1c) as compared to the initial viscosity.

Starting compositions D, E, and F comprising cellulose fibers had an initial viscosity between 323 mPa·s and 638 mPa·s. The addition of 1000 ppm of the hydrotrope (Ex. 4c, 5c, 6c) led to only a minor viscosity decrease between 17% (Ex. 5c) and 25% (Ex. 4c) as compared to the initial viscosity. Also in examples 4c to 6c, a dynamic yield stress was still present after hydrotrope addition as illustrated in Table 3. Because of the change in rheological properties was small in presence of a cationic hydrotrope, post-addition of extra rheology modifier would not have been required.

For comparison, anionic hydrotrope sodium cumene sulfonate was added to starting composition G. The addition of 500 ppm and 1000 ppm sodium cumene sulfonate led to a viscosity decrease to 272 mPa·s and 254 mPa·s, respectively. Moreover, the addition of such anionic hydrotrope led to the formation of clearly visible white flocs, and therefore makes anionic hydrotropes not suitable.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid fabric softener composition comprising:

a) from about 3.0% to about 25.0% by weight of the composition of a quaternary ammonium ester softening active b) from about 0.005% to about 1.0% by weight of the composition of a cationic hydrotrope, wherein the cationic hydrotrope has the general structure:

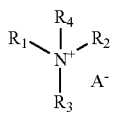

wherein:

each $R_1$, $R_2$, $R_3$, $R_4$ is independently selected from alkyl, $C_1$ to $C_4$ hydroxyalkyl, or $C_2$-$C_4$ alkoxy alcohol; and $A^-$ is independently selected from the group consisting of chloride, methyl sulfate, and ethyl sulfate;

with the proviso that the cationic hydrotrope comprises at least about 6 to about 8 carbon atoms in total; and c) cellulose fibers.

2. The liquid fabric softener composition according to claim 1 wherein the cationic hydrotrope is selected from the group consisting of bis (2-hydroxyethyl) dimethylammonium chloride, bis (2-hydroxyethyl) dimethylammonium methylsulfate, tris(2-hydroxyethyl) methylammonium chloride, tris(2-hydroxyethyl) methylammonium methylsulfate, bis (2-hydroxypropyl) dimethylammonium chloride, bis (2-hydroxypropyl) dimethylammonium methylsulfate, bis (1-methyl-2-hydroxyethyl) dimethylammonium chloride, bis (1-methyl-2-hydroxyethyl) dimethylammonium methylsulfate.

3. The liquid fabric softener composition according to claim 1, wherein the quaternary ammonium ester softening active has the following formula:

$$\{R^2_{(4-m)}—N+-[X—Y—R^1]_m\}A^-$$

wherein:

m is 1, 2 or 3 with proviso that the value of each m is identical;

each $R^1$ is independently hydrocarbyl, or branched hydrocarbyl group;

each $R^2$ is independently a $C_1$-$C_3$ alkyl or hydroxyalkyl group;

each X is independently $(CH_2)n$, $CH_2$—$CH(CH_3)$— or CH—$(CH_3)$—$CH_2$—;

each n is independently 1, 2, 3 or 4;

each Y is independently —O—(O)C— or —C(O)—O—; and $A^-$ is independently selected from the group consisting of chloride, methyl sulfate, and ethyl sulfate;

with the proviso that the sum of carbons in each $R^1$, when Y is —O—(O)C—, is from about 13 to about 21.

4. The liquid fabric softener composition according to claim 1, wherein the iodine value of the parent fatty acid compound from which the quaternary ammonium ester softening active is formed is from about 15 to about 45.

5. The liquid fabric softener composition according to claim 1, wherein the quaternary ammonium ester softening active is present at a level of from about 7.0% to about 12% by weight of the composition.

6. The liquid fabric softener composition according to claim 1, wherein the cellulose fiber is present at a level of from about 0.1% to about 0.75% by weight of the composition.

7. The liquid fabric softener composition according to claim 1, wherein the cellulose fiber is microfibrous cellulose.

8. The liquid fabric softener composition according to claim 1, wherein the cellulose fibers have an average diameter from about 50 nm to about 200 nm.

9. The liquid fabric softener composition according to claim 1, wherein the composition has a viscosity between about 150 mPa·s and about 500 mPa·s as measured with a rotational viscometer, using spindle 2 for viscosities between about 50 mPa·s and about 400 mPa·s, and using spindle 3 for viscosities between about 400 mPa·s and about 800 mPa·s, at about 60 rpm, at about 21° C.

10. The liquid fabric softener composition according to claim 1, wherein the composition has a dynamic yield stress at about 20° C. between about 0.01 Pa and about 0.5 Pa.

11. The liquid fabric softener composition according to claim 1, comprising a dispersed perfume, wherein the perfume is present at a level of about 0.5% to about 5.0% by weight of the composition.

12. The liquid fabric softener composition according to claim 1, comprising from about 0.05% to about 2.0% by weight of encapsulated benefit agent, said encapsulated benefit agent is encapsulated in capsules wherein said capsules comprise a capsule wall, said capsule wall comprising wall material selected from the group consisting of melamine, polyacrylamide, silicones, silica, polystyrene, polyurea, polyurethanes, polyacrylate based materials, polyacrylate esters based materials, gelatin, styrene malic anhydride, polyamides, aromatic alcohols, polyvinyl alcohol, resorcinol-based materials, poly-isocyanate-based materials, acetals, starch, cellulose acetate phthalate and mixtures thereof.

* * * * *